US006170311B1

(12) United States Patent
Daub

(10) Patent No.: US 6,170,311 B1
(45) Date of Patent: Jan. 9, 2001

(54) DEVICE WITH A STEPPED ADJUSTMENT FOR ADAPTING THE VERTICAL POSITION OF ROLLS TO THE ROLLING LINE

(75) Inventor: Dieter Daub, Hilchenbach (DE)

(73) Assignee: SMS Schloemann-Siemag Aktiengesellschaft, Düsseldorf (DE)

( * ) Notice: Under 35 U.S.C. 154(b), the term of this patent shall be extended for 0 days.

(21) Appl. No.: 09/349,629

(22) Filed: Jul. 8, 1999

(30) Foreign Application Priority Data

Jul. 11, 1998 (DE) ..... 198 31 105

(51) Int. Cl.[7] ..... B21B 31/07; B21B 31/24
(52) U.S. Cl. ..... 72/240; 72/248
(58) Field of Search ..... 72/240, 248, 237, 72/245

(56) References Cited

U.S. PATENT DOCUMENTS 2,961,901 * 11/1960 Wheeler ..... 72/240
4,332,192 * 6/1982 Joutsjoki ..... 72/240

FOREIGN PATENT DOCUMENTS 4417274 11/1995 (DE) .
0513946 2/1995 (EP) .

* cited by examiner

*Primary Examiner*—Rodney A. Butler
(74) *Attorney, Agent, or Firm*—Friedrich Kueffner

(57) ABSTRACT

A device with a stepped adjustment for adapting the vertical position of the rolls of a roll stand to the rolling line, wherein the rolls are supported on both sides in chocks and arranged so as to be raisable and lowerable in roll housings, particularly in a four-high skin pass stand or sizing stand operated with low rolling force. The chocks of one of the rolls have on their sides facing the roll housings a toothed segment and complementary toothed rails are arranged in the roll housings opposite the toothed segments and are movable toward and away from the toothed segments.

6 Claims, 3 Drawing Sheets

DEVICE WITH A STEPPED ADJUSTMENT FOR ADAPTING THE VERTICAL POSITION OF ROLLS TO THE ROLLING LINE

BACKGROUND OF THE INVENTION

1. Field of the Invention

The present invention relates to a device with a stepped adjustment for adapting the vertical position of the rolls of a roll stand to the rolling line, wherein the rolls are supported on both sides in chocks and arranged so as to be raisable and lowerable in roll housings, particularly in a four-high skin pass stand or sizing stand operated with low rolling force.

2. Description of the Related Art

For rolling technological reasons, different roll diameters have to be used in roll stands; this primarily concerns the work rolls. Different measures are known for adjusting the upper edges of the work rolls to the rolling line to ensure that the diameter differences of the rolls do not result in substantial changes of the rolling line. These measures include, for example, the placement of fitting plates selected in accordance with the required dimension of compensation, selectively moving fitting pieces of different heights received in a sliding frame under the chocks into the housing windows of a four-high stand, or wedge-type adjustments with a pair of wedges arranged under each chock of the back-up roll, as disclosed in EP 0 513 946 B1. These pairs of wedges are arranged in such a way that each upper wedge element can be raised and lowered by means of a lifting device together with the respective roll chock and the wedge surfaces of both wedges are provided with steps, wherein the steps engage into each other so as to support the wedge elements. These known step-type adjustments are very complicated and make the roll exchange very difficult.

DE 44 17 274 A1discloses rolling in the same roll stand high-strength steel qualities as well as very soft steel qualities which can also be deep-drawn well in skin passes with very small rolling forces, wherein the cumulative rolling force of at most 1,000 t is very low as compared to reducing stands. The rolling force required for the skin pass procedure is applied, after lifting a back-up roll, by the bending device of one of the remaining rolls of the roll set of the lifted back-up roll. In this stand, the rolling line adjustment by means of the conventional wedges is very complicated.

SUMMARY OF THE INVENTION

Therefore, it is the primary object of the present invention to provide a device of the above-described type which can be used with reduced technical means universally, i.e., for example, in two-high stands as well as four-high stands or six-high stands, particularly in-line four-high skin pass stands, and wherein a rapid work roll exchange is possible.

In accordance with the present invention, the chocks of one of the rolls have on their sides facing the roll housings a toothed segment and complementary toothed rails are arranged in the roll housings opposite the toothed segments and are movable toward and away from the toothed segments.

Consequently, the stepped adjustment in the form of complimentary toothed segments and toothed rails—wherein the toothed segments advantageously are shorter than the toothed rails because they are located in the chocks which are anyhow guided in the windows of the roll housings so as to be raisable and lowerable—is located exclusively outside of the space required for the roll exchange, so that the roll exchange can carried out unimpededly and quickly. In addition, the roll housings can be of simple construction, for example, smooth, as is the case with respect to the toothed elements which engage each other and, depending on their construction, can also transmit high rolling forces in the engaged position. The secure engagement in the tooth gaps after the adjustments can be achieved by a distance measuring system mounted in the crossbeam of the housing, wherein the distance measuring system is connected to a higher-order control.

In accordance with a further development of the invention, the toothed rails are arranged so as to be actuated by cylinders and slidable in vertical slots of the roll housings. The length and the width of the vertical slots correspond to the dimensions (for example, about 80 mm wide and about 650 mm high or long) of the toothed rails which are generally plate-shaped. The toothed rails are connected to the piston rod of a suitable cylinder flanged from the outside to the roll housing. The length of the plate-shaped toothed rails is determined by the roll diameter differences which are being used. As predetermined by the higher-order control, the cylinders move the toothed rails toward the rear or away from the toothed segments of the chocks into the disengaged position, and, as soon as the toothing of the toothed rails has engaged in the vertical slots of the roll housing, the roll sets are completely exposed for carrying out the work roll exchange. After mounting a new set of work rolls, it is merely necessary to lift the chock with the toothed segments into the new position, which can be carried out by means of the balancing cylinders. Subsequently, it is merely necessary to reverse the control of the cylinder drives of the toothed rails for placing the toothed rails in engagement with the toothed segments.

In accordance with a further development of the invention, the toothed segments are formed on discs which are loosely placed in recesses of the side surfaces of the chocks. Since the toothed segment is pivotable or movable to a certain extent as a result of the loose seat of the disc, the toothed segment can automatically adapt to the bending line predetermined for the work rolls and/or intermediate rolls by means of the bending devices or to changes of the bending line as a result of the rolling force.

In accordance with another proposal of the present invention, the discs are engaged on both sides of the toothed segments by wear or sliding plates screwed to the side surfaces of the chocks. This makes it possible to utilize the wear plates, which are present anyhow, to continue to securely hold the discs which are loosely placed in the recesses without limiting the mobility of the discs.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
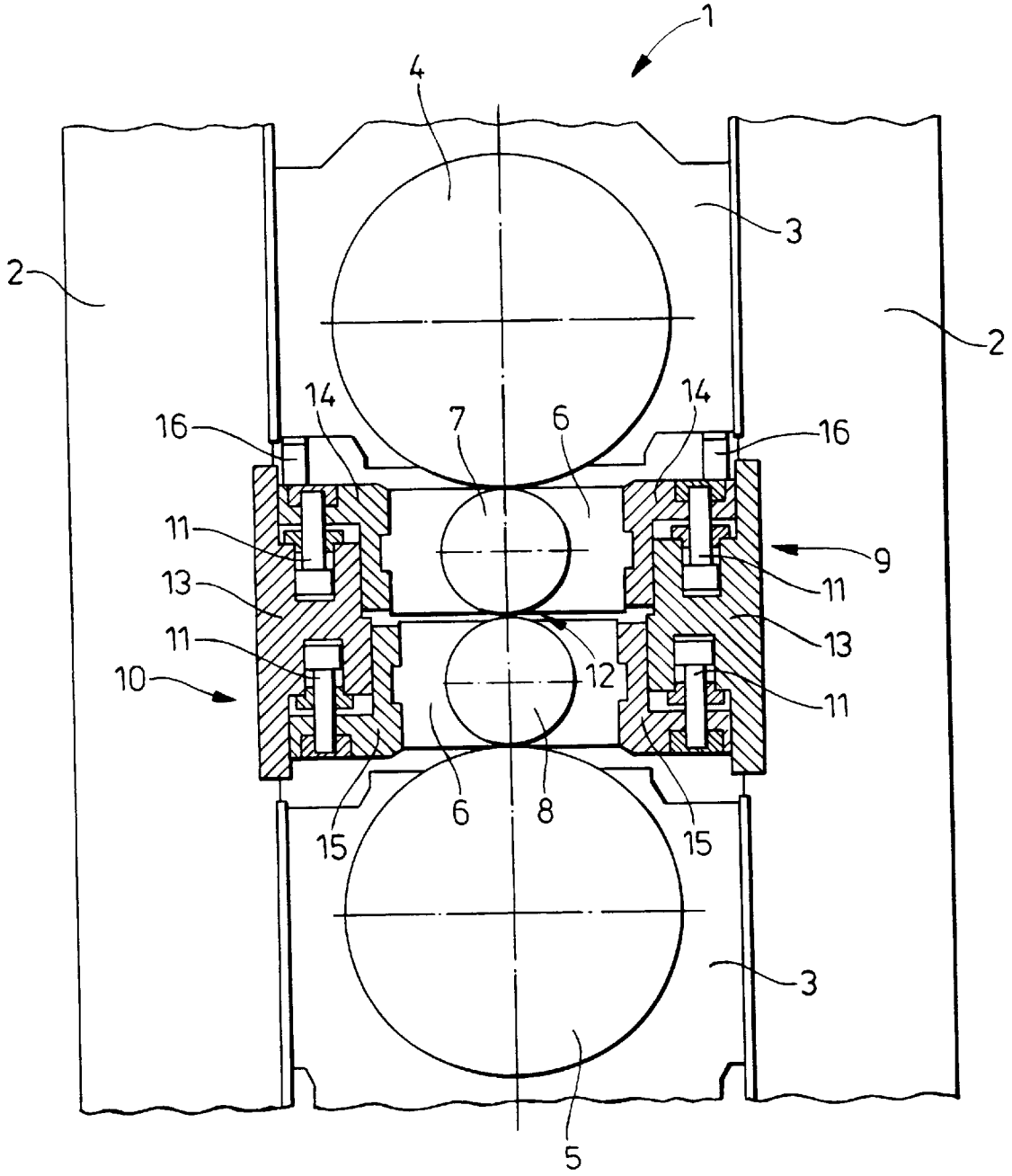
FIG.1 PRIOR ART
FIG. 1 is a schematic view, partially in section, of a portion of a conventional four-high roll stand seen in axial direction of the rolls.

FIG. 1 of the drawing shows an embodiment of the present invention in a four-high roll stand 1. Specifically, FIG. 1 shows one of the two roll housings in a partial front view. In the housing windows of the roll stand, an upper and a lower back-up roll 4, 5 are supported with chocks 3 and an upper and a lower work roll 7, 8 are supported with chocks 6. The back-up rolls 4, 5 are braced against the work rolls 7, 8 from the top and from the bottom, respectively.

In this embodiment, a bending system or bending device 9, 10 is provided for the upper work roll 7 as well as for the lower work roll 8. Each bending device includes as integrated components bending cylinders 11 which are designed for carrying out a positive bending action. However, a negative or positive and negative bending action are also possible for influencing the roll gap 12 between the work rolls 7 and 8.

Provided for the work rolls 7 and 8 are bending blocks 13 which are provided on the operator side as well as on the drive side with movable upper and lower guide frames 14 and 15. Cylinders 16 for lifting or balancing the upper back-up roll 4 arranged in the bending blocks 13 or the guide frames 14 are provided for the chock 3 of the upper back-up roll 4.

Figure 2:
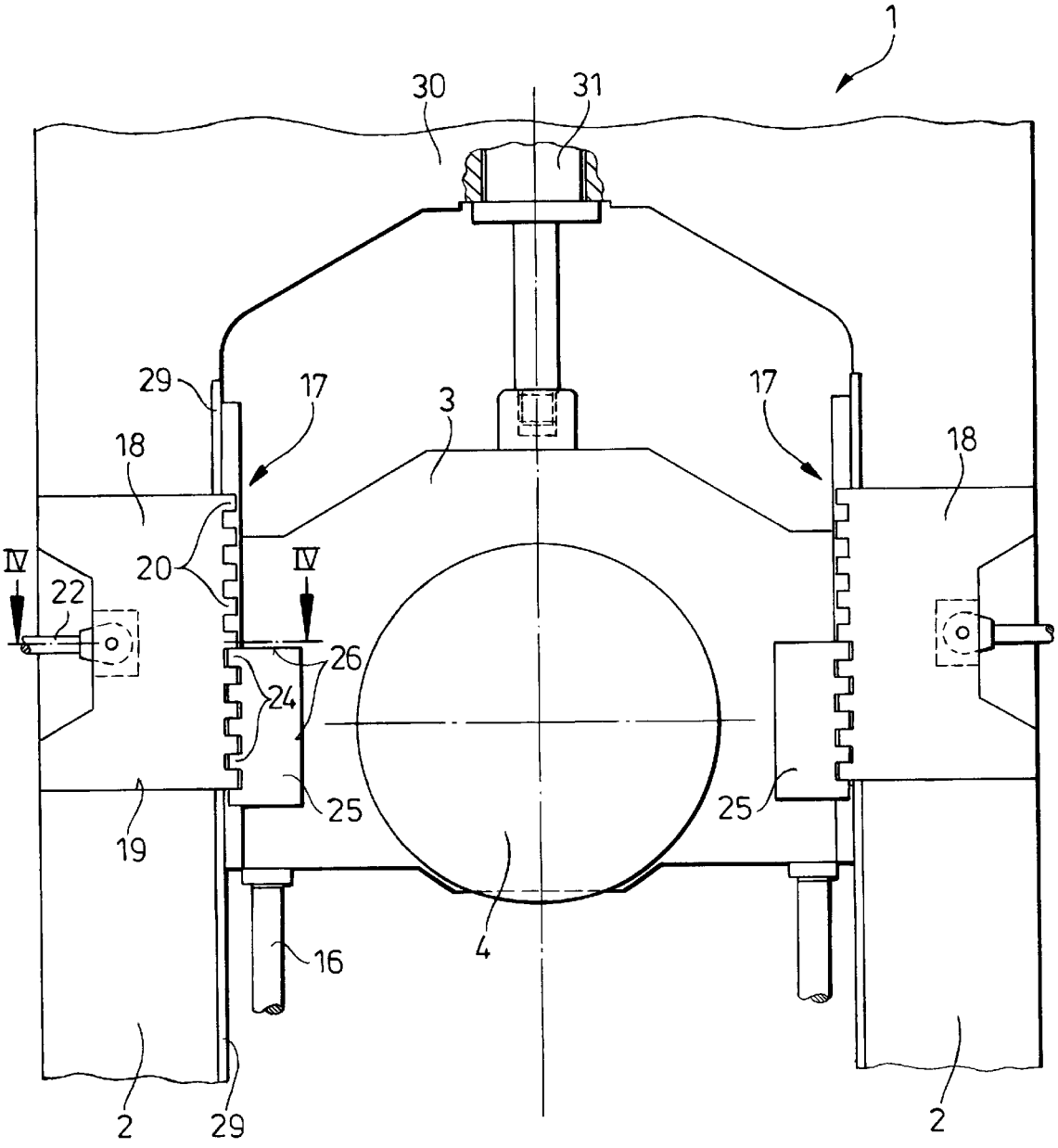
FIG. 2 shows a detail of the back-up roll of the roll stand of FIG. 1 with a toothed stepped adjustment arranged in the area of the left roll housing.
Figure 3:
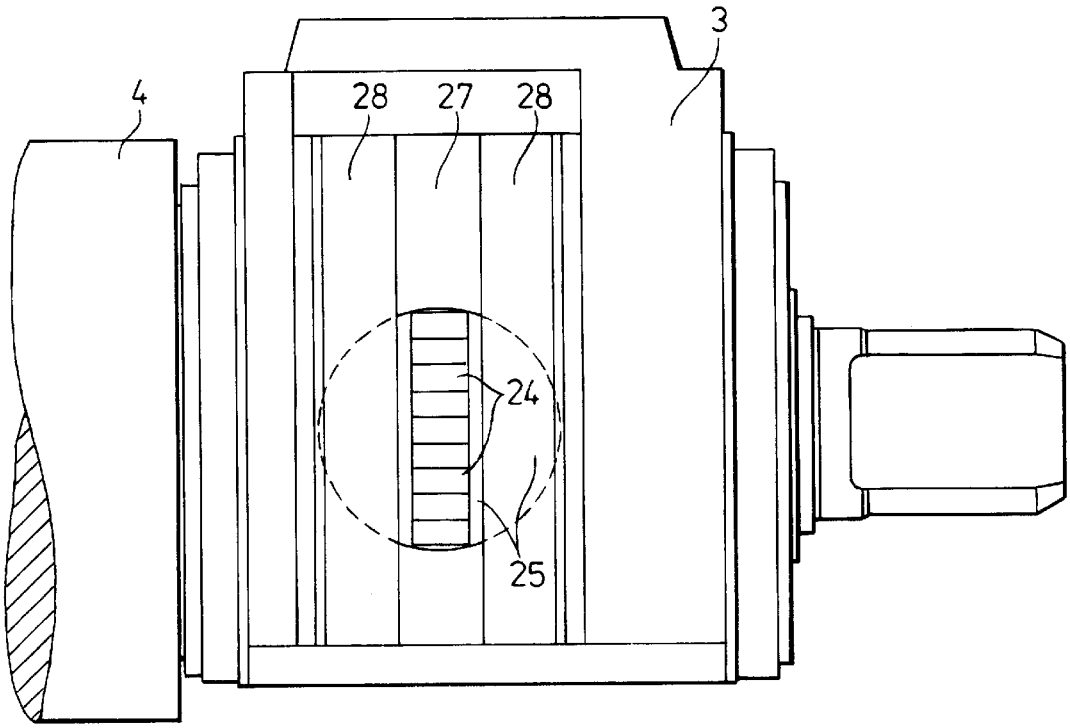
FIG. 3 is a side view showing a detail of the back-up roll chock of FIG. 2.
Figure 4:
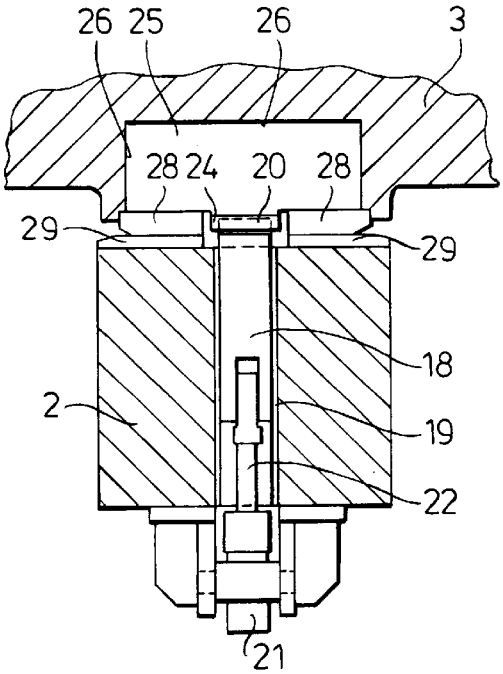
FIG. 4 is a sectional view taken along sectional line IV—IV of FIG. 2.

For adjusting the vertical position of the work rolls 7, 8 of a set of work rolls which has been mounted by means of a work roll changing device, not shown, to replace a previous set of work rolls with a different diameter relative to the rolling line or pass line, stepped adjusting means 17 are provided for the chocks 3 on both sides (FIG. 3 only shows the chock on the drive side) of the upper back-up roll 4 on the housing side for both roll housings. Each stepped adjusting means 17 includes a plate-shaped toothed rail 18 which is slidably guided in a vertical slot 19 of the roll housing 2, as seen in FIG. 4. The stepped adjusting means 17 further includes at its end facing the chock 3 a toothed section 20. Adjusting cylinders 21 are coupled through their piston rods 22 to the respective toothed rail 18, wherein the adjusting cylinders 21 are flanged from the outside to the roll housing 2 and, of course, also to the other roll housing which is located in axial direction or in the plane of the drawing of FIGS. 1 and 2 behind the first roll stand 2. Consequently, when the cylinders 21 are actuated, the toothed rails 18 are moved in a direction toward or away from the chocks 3 of the upper back-up roll 4. The stepped adjusting means 17 are completed by complementary rack segments 24 which are formed on discs 25 or disc bodies. The discs 25 are placed loosely in recesses 26 or the side surfaces 27 of the chocks and are surrounded on both sides of the rack segments 24 by the wear or slide plates 28 screwed to the chocks and are held securely in their position, but rotatable to a limited extent, as is clear from FIG. 3. As can be seen in FIGS. 2 and 4, such wear or slide plates 29 are also arranged on the inner sides of the roll housings 2 facing the chocks 3.

Accordingly, for adjusting the set of work rolls to the rolling line, it is merely necessary to move or pull the toothed rails 18 by means of the adjusting cylinders 21 back into the roll housing 2 to such an extent until its toothed section 20 no longer protrudes into the housing window (this position is shown in dash-dot lines in FIG. 2 for the toothed section) and, thus, is disengaged from he rack segments 24 of the chocks 3. Subsequently, by means of the balancing cylinders 16, the chocks 3 of the upper back-up roll 4 can then be raised or lowered until the vertical position adjusted to the rolling line is reached. When the toothed rails 18 are then moved forward again, they engage with their toothed sections 20 into the oppositely located rack segments 24 of the chocks 3, as illustrated in solid lines in FIG. 2. With the use of a distance measuring system 31 arranged in the crossbeams 30 of the roll housing 20 it is ensured through a higher-order control that the stepped adjusting means 17 of the raised or lowered chocks 3 of the back-up roll 4 once again reach a securely engaged position.

While specific embodiments of the invention have been shown and described in detail to illustrate the inventive principles, it will be understood that the invention may be embodied otherwise without departing from such principles.

I claim:

1. In a roll stand having rolls mounted on both sides thereof in chocks and arranged so as to be raisable and lowerable in roll housings, the improvement comprising a device with stepped adjusting means for adjusting a vertical position of the rolls relative to a rolling line, the stepped adjusting means comprising rack segments mounted in the chocks of one of the rolls on sides thereof facing the roll housings, and complementary toothed rails mounted in the roll housings so as to be movable toward and away from the rack segments.

2. The roll stand according to claim 1, wherein the roll stand is a four-high skin pass stand operated at a low rolling force.

3. The roll stand according to claim 1, wherein the toothed rails are mounted in vertical slots of the roll housings, further comprising cylinders for slidingly moving the toothed rail in the vertical slots.

4. The roll stand according to claim 1, wherein the rack segments are formed on discs, and wherein the discs are loosely placed in recesses of side surfaces of the chocks.

5. The roll stand according to claim 1, wherein the rack segments have a shorter length than the toothed rails.

6. The roll stand according to claim 4, further comprising wear or slide plates engaging the discs on both sides of the rack segments, wherein the wear and slide plates are screwed to the side surfaces of the chocks.

* * * * *